US008857457B2

(12) United States Patent
Zabaras

(10) Patent No.: US 8,857,457 B2
(45) Date of Patent: Oct. 14, 2014

(54) SYSTEMS AND METHODS FOR PRODUCING AND TRANSPORTING VISCOUS CRUDES

(75) Inventor: George John Zabaras, Houston, TX (US)

(73) Assignee: Shell Oil Company, Houston, TX (US)

( * ) Notice: Subject to any disclaimer, the term of this patent is extended or adjusted under 35 U.S.C. 154(b) by 185 days.

(21) Appl. No.: 13/382,328

(22) PCT Filed: Jul. 6, 2010

(86) PCT No.: PCT/US2010/041042

§ 371 (c)(1), (2), (4) Date: Jan. 5, 2012

(87) PCT Pub. No.: WO2011/005744

PCT Pub. Date: Jan. 13, 2011

(65) Prior Publication Data

US 2012/0111415 A1 May 10, 2012

Related U.S. Application Data

(60) Provisional application No. 61/223,924, filed on Jul. 8, 2009.

(51) Int. Cl.
*F17D 1/16* (2006.01)
*F17D 1/08* (2006.01)

(52) U.S. Cl.
CPC ..... *F17D 1/08* (2013.01)
USPC ..... 137/13; 137/605; 166/300; 166/369

(58) Field of Classification Search
USPC ..... 137/605, 13; 166/105, 275, 300, 369
See application file for complete search history.

(56) References Cited

U.S. PATENT DOCUMENTS

| | | | | |
|---|---|---|---|---|
| 3,502,103 | A * | 3/1970 | Verschuur | 137/565.33 |
| 3,826,279 | A * | 7/1974 | Verschuur | 137/896 |
| 3,977,469 | A * | 8/1976 | Broussard et al. | 166/266 |
| 4,745,937 | A * | 5/1988 | Zagustin et al. | 137/13 |
| 5,159,977 | A | 11/1992 | Zabaras | 166/105 |
| 5,199,496 | A * | 4/1993 | Redus et al. | 166/366 |
| 5,863,301 | A * | 1/1999 | Grosso et al. | 44/301 |
| 6,983,802 | B2 * | 1/2006 | Bolin et al. | 166/369 |
| 7,121,339 | B2 | 10/2006 | Bragg et al. | 166/275 |

FOREIGN PATENT DOCUMENTS

WO WO2006132892 * 12/2006 ..... E03B 7/02

* cited by examiner

*Primary Examiner* — John K Fristoe, Jr.
*Assistant Examiner* — Reinaldo Sanchez-Medina

(57) ABSTRACT

There is disclosed a system adapted to transport two fluids, comprising a nozzle comprising a first nozzle portion comprising the first fluid; and a second nozzle portion comprising the second fluid, wherein the second nozzle portion has a larger diameter than and is about the first nozzle portion; and a tubular fluidly connected to and downstream of the nozzle, the tubular comprising the first fluid in a core, and the second fluid about the core; the first fluid comprising a crude oil having a total acid number greater than 1, and the second fluid comprising a basic solution having a pH greater than 8.

9 Claims, 4 Drawing Sheets

SYSTEMS AND METHODS FOR PRODUCING AND TRANSPORTING VISCOUS CRUDES

PRIORITY CLAIM

The present application claims priority from PCT/US2010/041042, filed 6 Jul. 2010, which claims priority from U.S. provisional application 61/223,924, filed 8 Jul. 2009.

FIELD OF THE INVENTION

The field of the invention relates to core flow of fluids through a tubular.

BACKGROUND OF THE INVENTION

Core-flow represents the pumping through a pipeline of a viscous liquid such as oil or an oil emulsion, in a core surrounded by a lighter viscosity liquid, such as water, at a lower pressure drop than the higher viscosity liquid by itself. Core-flow may be established by injecting the lighter viscosity liquid around the viscous liquid being pumped in a pipeline. Any light viscosity liquid vehicle such as water, petroleum and its distillates may be employed for the annulus, for example fluids insoluble in the core fluid with good wettability on the pipe may be used. Any high viscosity liquid such as petroleum and its by-products, such as extra heavy crude oils, bitumen or tar sands, and mixtures thereof including solid components such as wax and foreign solids such as coal or concentrates, etc. may be used for the core.

Friction losses may be encountered during the transporting of viscous fluids through a pipeline. These losses may be due to the shear stresses between the pipe wall and the fluid being transported. When these friction losses are great, significant pressure drops may occur along the pipeline. In extreme situations, the viscous fluid being transported can stick to the pipe walls, particularly at sites that may be sharp changes in the flow direction.

To reduce friction losses within the pipeline, a less viscous immiscible fluid such as water may be injected into the flow to act as a lubricating layer for absorbing the shear stress existing between the walls of the pipe and the fluid. This procedure is known as core flow because of the formation of a stable core of the more viscous fluid, i.e. the viscous oil, and a surrounding, generally annular, layer of less viscous fluid.

Core flow may be established by injecting the less viscous fluid around the more viscous fluid being pumped in the pipeline.

Although fresh water may be the most common fluid used as the less viscous component of the core flow, other fluids may be used.

The world's easily found and easily produced petroleum energy reserves are becoming exhausted. Consequently, to continue to meet the world's growing energy needs, ways must be found to locate and produce much less accessible and less desirable petroleum sources. Wells may be now routinely drilled to depths which, only a few decades ago, were unimagined. Ways are being found to utilize and economically produce reserves previously thought to be unproducible (e.g., extremely high temperature, high pressure, corrosive, acidic, sour, and so forth). Secondary and tertiary recovery methods are being developed to recover residual oil from older wells once thought to be depleted after primary recovery methods had been exhausted.

Some reservoir fluids have a low viscosity and may be relatively easy to pump from the underground reservoir. Others have a very high viscosity even at reservoir conditions.

Others have a high acidity which may be corrosive to tubulars, pumping equipments, and later to refinery equipment.

Electrical submersible pumps may be used with certain reservoir fluids, but such pumps generally lose efficiency as the viscosity of the reservoir fluid increases.

If the produced crude oil in a well has a high viscosity for example, viscosity from about 200 to about 2,000,000 (centiPoise) cP, then friction losses in pumping such viscous crudes through tubing or pipe can become very significant. Such friction losses (of pumping energy) may be due to the shearing stresses between the pipe or tubing wall and the fluid being transported. This can cause significant pressure gradients along the pipe or tubing. In viscous crude production such pressure gradients cause large energy losses in pumping systems, both within the well and in surface pipelines.

U.S. Pat. No. 5,159,977, discloses that the performance of an electrical submersible pump may be improved by injection of water such that the water and the oil being pumped flow in a core flow regime, reducing friction and maintaining a thin water film on the internal surfaces of the pump. U.S. Pat. No. 5,159,977 is herein incorporated by reference in its entirety.

Co-pending patent publication WO 2006/132892, discloses a system adapted to transport two fluids and a gas comprising a nozzle comprising a first nozzle portion comprising the first fluid and the gas, and a second nozzle portion comprising the second fluid, wherein the second nozzle portion has a larger diameter than and is about the first nozzle portion; and a tubular fluidly connected to and downstream of the nozzle, the tubular comprising the first fluid and the gas in a core, and the second fluid about the core. Co-pending patent application WO 2006/132892 is herein incorporated by reference in its entirety.

Patent application MX2005PA007911 discloses a process for reducing naphthenic acidity in petroleum oil or its fraction comprises: providing the oil supply (0.1-99 wt. %) in water that is emulsified/dispersed in the oil, where the oil contain salts and naphthenic acid content is 0.1-10 mg that are measured by total acid number (TAN) measurement using KOH/g; sending the oil with the water towards a device, which is emitting microwave radiation, where the oil is subjected under the microwave radiations in liquid phase at 50-350 deg. C. under 0.7-4.5 MPa in which the microwave radiations have influencing distance of 1 mm-30 cm of the oil, in the presence of salts, applied temperature and the high permittivity of the water droplets involve absorption of heat preferably heating water in the place of oil, the naphthenic compounds interface between the droplets, and the oil absorb the heat; decomposing carboxylic acids (that is responsible for naphthenic acidity) of 320 deg. C. to liberate CO2; separating the formed gas, water and oil phases using a separating device; and recovering the oil having reduced amount of naphthenic acids. The process is applied for reducing naphthenic acid in oil or its fractions during the oil production-phase performed in refineries or any other industrial facility. Patent application MX2005PA007911 is herein incorporated by reference in its entirety.

There is a need in the art to provide economical, simple techniques for moving viscous fluids in a tubular.

SUMMARY OF THE INVENTION

One aspect of the invention provides a system adapted to transport two fluids, comprising a nozzle comprising a first nozzle portion comprising the first fluid; and a second nozzle portion comprising the second fluid, wherein the second nozzle portion has a larger diameter than and is about the first nozzle portion; and a tubular fluidly connected to and downstream of the nozzle, the tubular comprising the first fluid in a core, and the second fluid about the core; the first fluid comprising a crude oil having a total acid number greater than 1, and the second fluid comprising a basic solution having a pH greater than 8.

Another aspect of invention provides a method for transporting a first fluid, a second fluid, and a gas, comprising injecting the first fluid through a first nozzle portion into a core portion of a tubular; injecting the second fluid through a second nozzle portion into the tubular, the second fluid injected about the core portion of the first fluid and the gas; wherein the first fluid comprises a hydrocarbon liquid having a total acid number greater than 2, and wherein the second fluid is a basic solution having a pH greater than 9.

Advantages of the invention may include one or more of the following:

A heavy and acidic crude oil can be upgraded during flow from the reservoir to the receiving facility by utilizing the coreflow technique.

Coreflow done with alkaline injected water will allow for enough mixing to result in neutralization of at least a portion of the organic acids contained in the oil.

Coreflow done with alkaline injected water may provide for both improved hydraulic performance and a higher value crude oil will be had at the receiving facility.

Since the well and/or a pipeline are used as neutralization reactors, no need to provide other neutralization reactors on an offshore platform where space and weight limitations are too costly.

Neutralization of an acidic crude oil may result in naphthenate salts that are known to be strong emulsifier thus having the potential to destroy coreflow by inducing too much mixing of the coreflow water. Coreflow in a well and/or a subsea flowline can be maintained for sufficiently longer times than typical fluid residence times of the fluid in the well and/or subsea flowline system.

DETAILED DESCRIPTION

Figure 1:
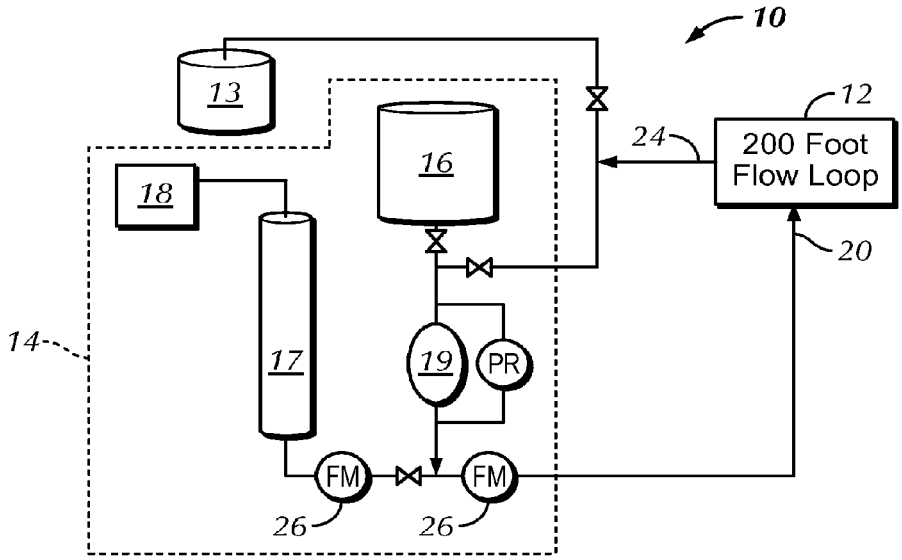
FIG. 1 is a schematic overview of a flow loop facility for performing a core flow TAN reduction flow loop in accordance with embodiments of the present disclosure.

In one aspect, embodiments disclosed herein relate generally to systems and methods for producing and transporting viscous crude oils. Specifically, embodiments disclosed herein relate to a method of producing and transporting acidic viscous crude oils. In one embodiment, the method neutralizes and/or destroys at least some of the organic acids present in the oils during transportation, reducing the total acid number ("TAN") of such oils by at least 40%, 50%, or 60%, for example to reduce the TAN to less than 5, 3, or 1. In one embodiment, a basic aqueous solution, such as an alkaline solution, is used to neutralize and/or destroy organic acids present in the viscous crude oils. As used herein, the term "total acid number" or "TAN" refers to the acid content of crude oil or of other hydrocarbon liquids and represents the milligrams of potassium hydroxide (KOH) required for neutralizing one gram of crude oil.

Crude oil and other liquid hydrocarbonaceous streams with a high amount of acids, for example with a TAN greater that 5, 7, or 10, are problematic for several reasons. First, they are difficult to refine—especially in the distillation unit of a crude oil refinery—and thus have a lower market value than those having a lower TAN. Additionally, high acid content may lead to severe corrosion of the refinery equipment. The reason for the corrosivity of the high-TAN crude is the contribution from organic acids, for example naphthenic acids. These problems are exacerbated when the crude oils, as processed, contain saltwater. The naphthenic acids effectively ion exchange with the cations in the saltwater to form hydrochloric acid (HCl) with severe corrosivity implications. Previous efforts to avoid these corrosion problems include blending different crude oil streams to obtain a crude oil feedstock with an acceptable amount of acids. However, this approach has its limitations such as availability of low-TAN crudes, non-compatability of crudes with respect to properties other than TAN value and specifics of the refinery designs and other downstream equipment. Other problems associated with high-TAN crudes include the deposition of calcium salts or naphthenates in topside locations and flow resistance resulting from higher viscosity fluids.

The transport of produced fluids from a deepwater reservoir (reservoirs having water depths exceeding about 600 feet) may be challenging due to the fluids having high viscosity (typically above 10 cP but often as high as 200 cP at the reservoir condition and 150,000 cP at stock tank condition), high TAN (from about 5 to about 10), and low API gravity (9-18), and thus could increase the price of oil. Using core flow technology is favorable to transport heavy crude oil with water due to the lubricating effect of the water film. The inventor has advantageously discovered that TAN reduction with core flow provides the ability to neutralize the acidic crude oil without significantly impairing the core flow pattern and the oil dehydration. Furthermore, the inventor has developed a notional plan for field application.

As used herein, the term "core flow" refers to a technology for transporting heavy crude oil with water. Specifically, core flow is a phenomenon in which the heavy oil in a pipe forms a concentric core with substantially all the water flowing substantially only near the pipe wall as an annular film. This flow is favorable to transport heavy crude oil with water due to the lubricating effect of the water film.

The TAN reduction may be achieved with core flow of crude in the middle surrounded by a basic aqueous solution. The water may be mixed with one or more of sodium hydroxide, potassium hydroxide, sodium carbonate, sodium bicarbonate, ammonia, amines, and/or magnesium hydroxide. Other basic aqueous solutions known in the art may also be used. Alternatively, a basic solution may be formulated with an alkali. Alkalis suitable for use in the alkaline aqueous solutions of the present disclosure include, for example, sodium hydroxide, sodium carbonate, sodium metaborate, sodium metasilicate, and triethylamine. In one embodiment of the present disclosure, the concentration of alkalis used to form the alkaline aqueous solutions is from about 1% to about 10% by weight of the total solution. In a preferred embodiment, the alkali is 4% (wt) sodium hydroxide.

Viscous crude oils may contain various acidic components which may be neutralized and/or destroyed by methods in accordance with embodiments of the present disclosure. Such acidic components may include, for example, carboxylic acids, sulphonic acids, phenols, amides, mercaptans, and naphthenic acids. In preferred embodiments of the present disclosure, acidic crude oils have an initial TAN of greater than 1, greater than 5, or greater than 9, which may be reduced to a final TAN of less than 5, 3, or 1.

In one embodiment of the present disclosure, a method for reducing the TAN of a heavy crude oil includes: using water to generate a core flow capable of transporting a heavy crude oil, wherein such crude oil has a TAN greater than 5; introducing an base (inorganic/organic) in the water, wherein such base reduces the heavy crude oil TAN to less than 3.

In a preferred embodiment, when the fluid is transported in the pipe, there is enough oil-water contact such that the naphthenic acids and/or other acids in the oil can react with the alkali in the water phase to convert the acids into salts. It is also preferred that the pipe wall be maintained as a water-wetting surface to prevent an emulsion from forming near the wall and to prevent disruption of the thin water film formed from the core flow. To ensure that the pipe wall is water-wet, the flow loop or tubular may be pre-washed by 500 ppm sodium metasilicate solution before each core flow is generated. One of ordinary skill in the art will appreciate that other solutions may be used without departing from the scope of embodiments disclosed herein.

The experiments discussed below show core flow TAN reduction through flow loop testing with fluids produced from a deepwater reservoir and an evaluation of the performance of the neutralization chemicals for the organic acid of the oil. In addition, different experimental techniques and chemical methods were evaluated to minimize the emulsification of a high acid number crude oil while reducing TAN.

EXAMPLE 1

First, the main acidic species present in high acid number crude oil from a deepwater reservoir (~5200 feet water depth) were identified using techniques such as high-resolution Fourier-Transform Ion Cyclotron mass spectrometry (FTICRMS). The machine used was The National High Field Fourier Transform Ion Cyclotron Resonance (FT-ICR) Mass Spectrometry Facility at the Florida State University with their 9.4 T high performance electrospray FT-ICR mass spectrometer instrument in the negative mode Using FTICRMS, the overwhelming majority of acidic components in the high acid number crude oil were found to be composed of $O_2$ species, which represent mono-carboxylic naphthenic acids. The predominant $O_2$ species contain 2, 1, and 3 rings respectively (i.e., Z=−4, Z=−2, and Z=−6) with carbon numbers between 28 and 35. Other minor acidic components in the high acid number crude oil included $N_1O_2$ species (e.g., amides) and $O_4$ species (bi-carboxylic naphthenic acids). Additional properties of the high acid number crude oil (Sample 1) are presented in Table 1, below. Table 1 also presents basic naphthenic acid information for the high acid number crude oil samples obtained after the ion-exchange procedures (Sample 2 and 3).

The acid IER method was used which was published by Statoil in an SPE publication (The Acid-IER Method—A Method for Selective Isolation of Carboxylic Acids from Crude Oils and Other Organic Solvents, SPE 80404, paper presented at the SPE 5th International Symposium of Oilfield Scale, held in Aberdeeen, UK, 29-30 Jan., 2003. Heidi Mediaas, Knut V. Grande, Britt M. Hustad, Anita Rasch, Hakon G. Rueslatten and Jens Emil Vindstad, Statoil ASA).

In summary, the resin has sugar based polymers which latch on to the carboxylic acid groups in the BS4 crude after activation. We showed it was possible to achieve free naphthenic acid removal of almost 100%.

TABLE 1

Comparison of different high acid number crude oil properties.

| Sample | TAN | Total HA (ppm) | HA Number Average m.w. (Da) | HA Weight Average m.w. (Da) | Salt Bound HA (ppm) | Free HA (ppm) | Salt Bound HA Reduction (%) | Free HA Reduction (%) | Water Content (wt %) | Total Salinity (mg/kg) |
|---|---|---|---|---|---|---|---|---|---|---|
| 1 | 9.8 | 32209 | 549 | 611 | 16427 | 15782 | n/a | n/a | 4.3 | 4300 |
| 2 | 5.2 | 12614 | 533 | 582 | 1892 | 10722 | 88 | 32 | 0.12 | 166 |
| 3 | 0.3 | 2132 | 509 | 561 | 2132 | <50 | 87 | 99 | n.m. | n.m. |

Note:
HA = naphthenic acid;
m.w. = molecular weight;
n.a. = not applicable;
n.m. = not measured As shown in Table 1, Sample 1 (the high acid number crude oil) was found to have a very high (~32000 ppm) naphthenic acid content, of which 51% (16427 ppm) was determined to be naphthenate salts (i.e., soluble salts where the metal content is originated in the dispersed water in the crude oil and the naphthenic acid content is originated from the bulk of the crude oil). The initial TAN may be measured using an ASTM D664 potentiometric titration method. For Sample 1, the initial TAN was 9.8. The number and average molecular weight of the naphthenic acids after ion-exchange are reduced for both Samples 2 and 3. The first ion-exchange procedure, Sample 2, resulted in a sample with 88% less salt-bound naphthenic acids in addition to 32% less free naphthenic acids. The naphthenic acid extraction was selective towards the predominant species in Sample 1. The TAN value of Sample 2 is 5.2 with 88% less salt-bound naphthenic acids after the first ion-exchange procedure.

The optimized second ion exchange procedure, Sample 3, results in similar reduction (~87%) of salt-bound naphthenic acids (compared to Sample 2) and is likely due to strong bonding between the naphthenic acids and metal species remaining at the oil-water interface, but with a significantly reduced TAN value of 0.3 and most (almost 100%) of the free naphthenic acids removed. We used the same procedures as described in the SPE publication for both the first and second extraction, the only difference was that in the second extraction we used more polymer for the extraction.

Additionally, the rheological properties of the samples were determined. For Sample 1, viscosity (determined using shear rate and temperature) was found to have an inverse relationship with temperature, that is, viscosity decreased as the temperature increased for the crude sample. For Sample 2, however, even lower viscosity levels (roughly one-third of Sample 1) were found. This decrease in viscosity may be due to selective removal of the naphthenic acids during the ion-exchange procedure, using a plate and plate type geometry rheometer. MCR 100 Rheometer (Anton-Paar), measuring system: CC27-SN0380 cylinder.

SARA analysis (a method for characterization of heavy oils based on fractionation) suggests the naphthenic acids in the high acid number crude oil (which were removed by ion-exchange) are part of the resin, asphaltene and aromatic solubility fractions. SARA analysis is the determination of the amount of saturates, aromatics, resins, and asphaltenes in a crude oil by a combination of induced precipitation (for asphaltenes) and column chromatography. The asphaltene analysis procedure uses n-heptane as the flocculating solvent, and is a modification of the standard IP143 procedure. Based on our calibration studies that contain data from over 20 asphaltene problem fields (and other 200 prospects/fields) worldwide, SARA-based parameters and plots have been developed to assess asphaltene stability. These include: resin/asphaltene vs saturate/aromatic plot of crude oil content, analysis of the elemental analysis of the asphaltene sample in conjunction with the nickel and vanadium concentration of the parent crude oil.

Asphaltene fractions from the high acid number crude oils were stable and of similar weight composition. Metal analysis of the high acid number crude oil suggests the presence of chlorides (e.g., potassium due to completion fluids) and salt-bound naphthenic acids (e.g., calcium, zinc). So for the metals like calcium and zinc we used a combination of ICP and XRF. For chlorides we included the ASTM salinity data which measured salts as chlorides. For the BS4 crude Cl: approx. 0.5% (m/m), and for the deacidified BS4 crude oil Cl: 0.44% (m/m).

Notably, the high metal species measured in the high acid number crude oil samples likely resulted from contamination from drilling and completion fluids used in the well where the samples were taken from. The presence of metals after ion-exchange suggests recalcitrant salt-bound naphthenic acids Z=−6, Z=−4, and Z=−8 (3, 2, and 4 rings, respectively) with carbon numbers between 20 and 30, which may lead to separation problems or even off-spec products during production.

EXAMPLE 2

A rotating wheel flow loop experiment was used to determine the actual TAN reduction results for some embodiments of the present disclosure. A rotating wheel flow loop consists of two semicircular pieces of glass tubing. First, the glass surface was treated with an appropriate concentration of sodium metasilicate solution to render it water-wet and thus enable the maintenance of a thin film of water on the pipe surface. Second, an aqueous phase, containing 300 ppm sodium metasilicate and a base material, is transferred to the wheel; both the aqueous phase and the wheel were pre-equilibrated at a predetermined concentration and temperature. Third, a high TAN crude oil, pre-equilibrated to the same temperature as the aqueous phase, was added to the wheel. After addition of the aqueous phase and high TAN crude oil, the wheel was rotated at a slow enough speed (~20 rpm) to prevent splashing of the water in the bath that was holding the experimental set up and to allow for samples to be withdrawn at predetermined intervals from the start of rotation. Such samples were used to determine the TAN and water content as well as to follow the progress of the removal of naphthenic acids and TAN reduction.

The TAN of the samples was measured using the standard ASTM D664 method. To ensure the accuracy of the TAN measurement, the water content of the samples was determined. The water content of the samples was measured using the Karl Fischer titration method; however, due to the presence of a base material in the sample, the water content was observed to increase (inflate upwards) the TAN of the samples. Generally, the water is emulsified as a water-in-oil emulsion; however, the water may be removed by diluting the sample with an excess volume of toluene containing 200 ppm of demulsifier and washing with a tenfold volume of 4% sodium chloride solution Specifically, an equal weight of toluene with demulsifier was added to a mixture of 20-30 g of sample. The mixture was shaken for two minutes in a mixing vial. Next, 20 mL of this dilution was mixed with 200 mL of 4% sodium chloride solution at 60° C. in a separatory funnel and shaken by hand for two minutes. On standing, a clean separation was effected and a known aliquot from the separated oil phase was used for the TAN measurement, after ensuring by Karl Fischer measurement on the sample that the water level in the oil phase is <0.1%. In the TAN measurement, an alcoholic KOH was used as titrant for the oil sample, which was dissolved in a titration solvent comprising toluene, isopropanol, and water (ratio 50:49.5:0.5), using ASTM standard procedure that describes the TAN measurement and is known as ASTM D664-95 (IP 177/96) method which is the commonly used method in the oil industry.

FIGS. 1 & 2:

FIG. 1 shows a schematic overview of the flow loop facility used to perform the core flow TAN reduction flow loop testing. The flow loop facility 10 consists of two sections, a flow loop section 12 and a processing section 14.

Figure 2:
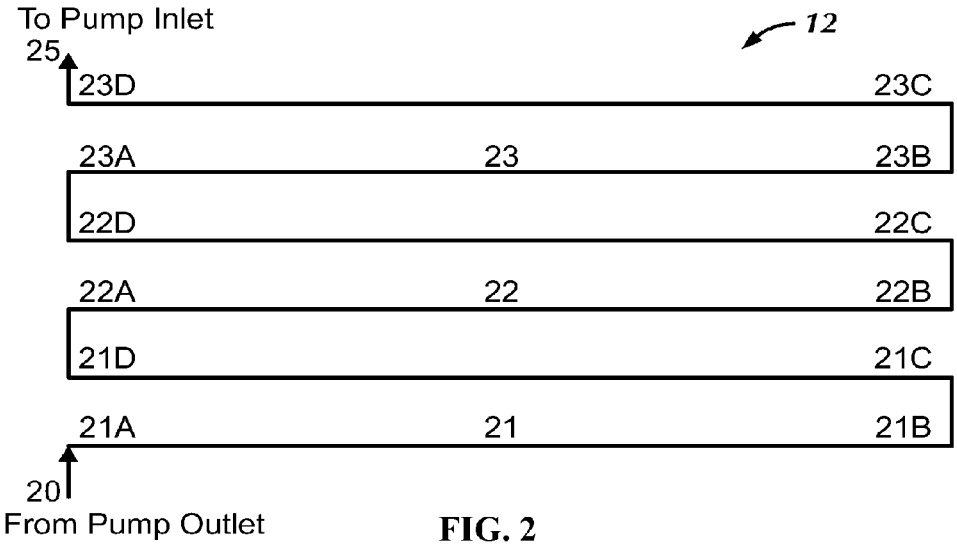
FIG. 2 is a schematic overview of the flow loop section of a flow loop facility for performing a core flow TAN reduction flow test in accordance with embodiments of the present disclosure.

As shown in FIG. 2, the flow loop section 12 may include a series of loops 21, 22, and 23 of ¾ inch (0.065 inch wall thickness) stainless steel tubing. Each loop may include two 50-foot straight sections (e.g., 21A-21B and 21C-21D) and two bends (6 foot diameter, ~12 feet long), which is approximately 100 feet in length. The straight loop sections may be housed in a 2 inch PVC pipe containing an ethylene glycol water mixture to control the temperature to testing temperature of about 100° F. The flow loop section 12 also includes an inlet 20 and an outlet 24. As shown in FIG. 1, the processing section 14 includes an oil supply vessel 16, a water supply vessel 17, a gas supply vessel 18, and a positive displacement pump 19. The flow loop facility may also have two flow meters 26, one for measuring water flow rate and the other for measuring the flow rate and density of the mixture stream (oil, water, and gas).

In accordance with embodiments of the present disclosure, the water supply vessel 17 may contain water (~20%) that includes at least one of several alkalis with different concentrations, such as sodium metasilicate, sodium chloride, sodium hydroxide, or potassium hydroxide, which together form an alkaline aqueous solution which may be used to neutralize acids present in the oil, as discussed above. The alkaline aqueous solution in the water supply vessel 17 may be pressurized (pushed out of the water supply vessel) by the gas (e.g., $N_2$) from the gas supply vessel 18. A gas booster (not shown) may be used to supply the gas. In one embodiment of the present disclosure, oil may be introduced from an oil supply vessel 16 into the processing section 14 of the flow loop facility 10 after a desired water rate is established. The oil may be pumped through the positive displacement pump 19 and mixed with the alkaline aqueous solution upstream of the flow meter 26. The flow rate of the oil may be controlled by the positive displacement pump 19 until a desired rate is reached. After oil is observed in the catch bucket 13 at the outlet 25 of the flow loop section 12, the flow loop section 12 may be isolated and the water/oil mixture allowed to circulate in the loop 12.

Figure 3:
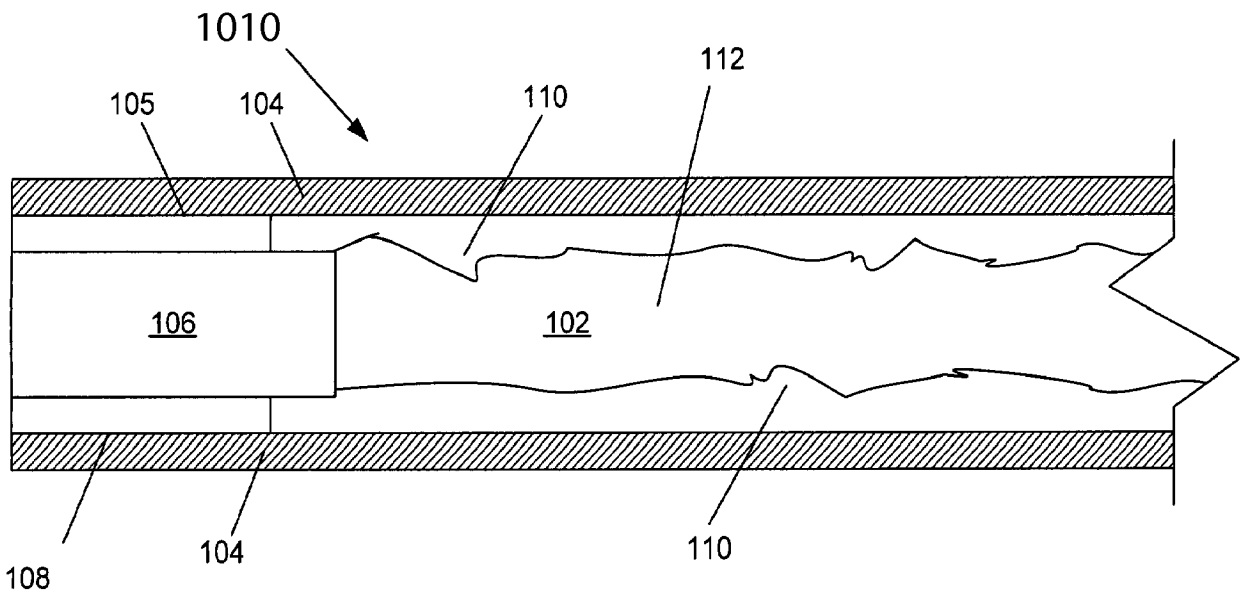
FIG. 3 is a cross-sectional view of a tubular with a nozzle with core flow.

FIGS. 3-5:

Referring now to FIG. 3, in some embodiments of the invention, a side view of tubular 1010 is illustrated. Tubular 1010 includes tube element 104 enclosing passage 102. Nozzle 105 may be provided in passage 102, and includes large diameter nozzle portion 108 and small diameter nozzle portion 106. A first fluid 112 and a gas may be pumped through small diameter nozzle portion 106, a second fluid 110 may be pumped through a large diameter nozzle portion 108.

In operation, the first fluid 112 and a gas travel as a core through passage 102 and may be completely surrounded by second fluid 110. Second fluid 110 may act as a lubricant, and/or eases the transportation of first fluid 112, so that the pressure drop for transporting first fluid 112 may be lower with a core flow than if the first fluid 112 were transported by itself.

Figure 4:
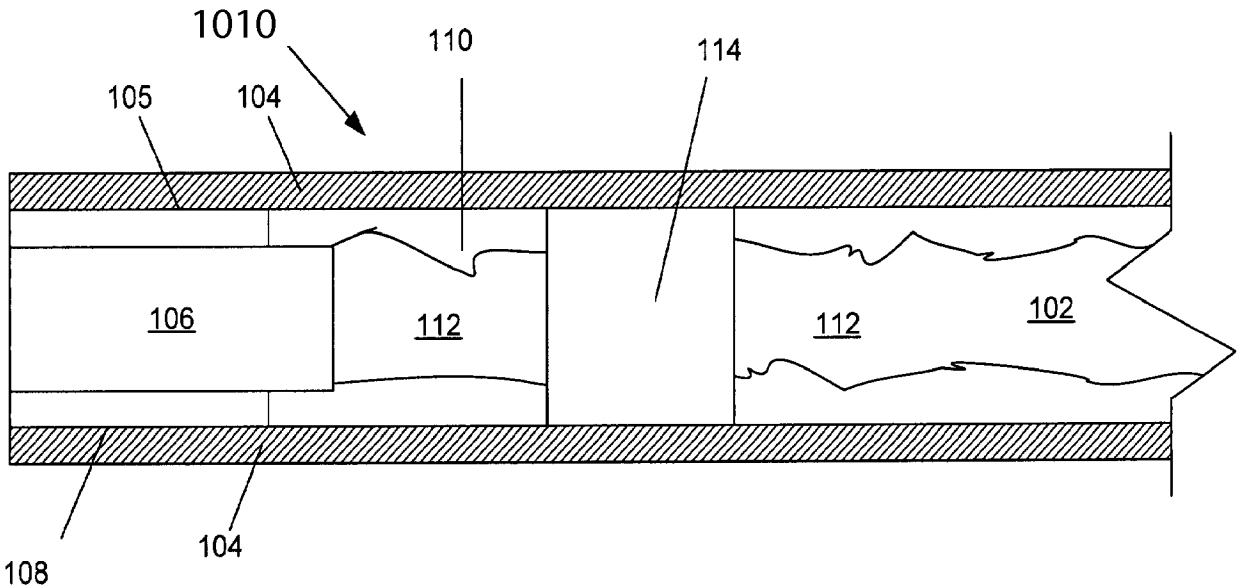
FIG. 4 is a cross-sectional view of a tubular with a nozzle and a pump with core flow.

Referring now to FIG. 4, in some embodiments of the invention, tubular 1010 is illustrated. Tubular 1010 includes tube element 104 enclosing passage 102. Nozzle 105 may be provided in passage 102, and includes large diameter nozzle portion 108 and small diameter nozzle portion 106. Small diameter nozzle portion 106 may be feeding first fluid 112 and optionally a gas, and large diameter nozzle portion 108 may be feeding second fluid 110 completely around first fluid 112. This creates a core flow arrangement of first fluid 112 and the gas, surrounded by second fluid 110. Pump 114 may be provided downstream of nozzle 105 to pump first fluid 112 and the gas and second fluid 110 through tubular 1010.

Figure 5:
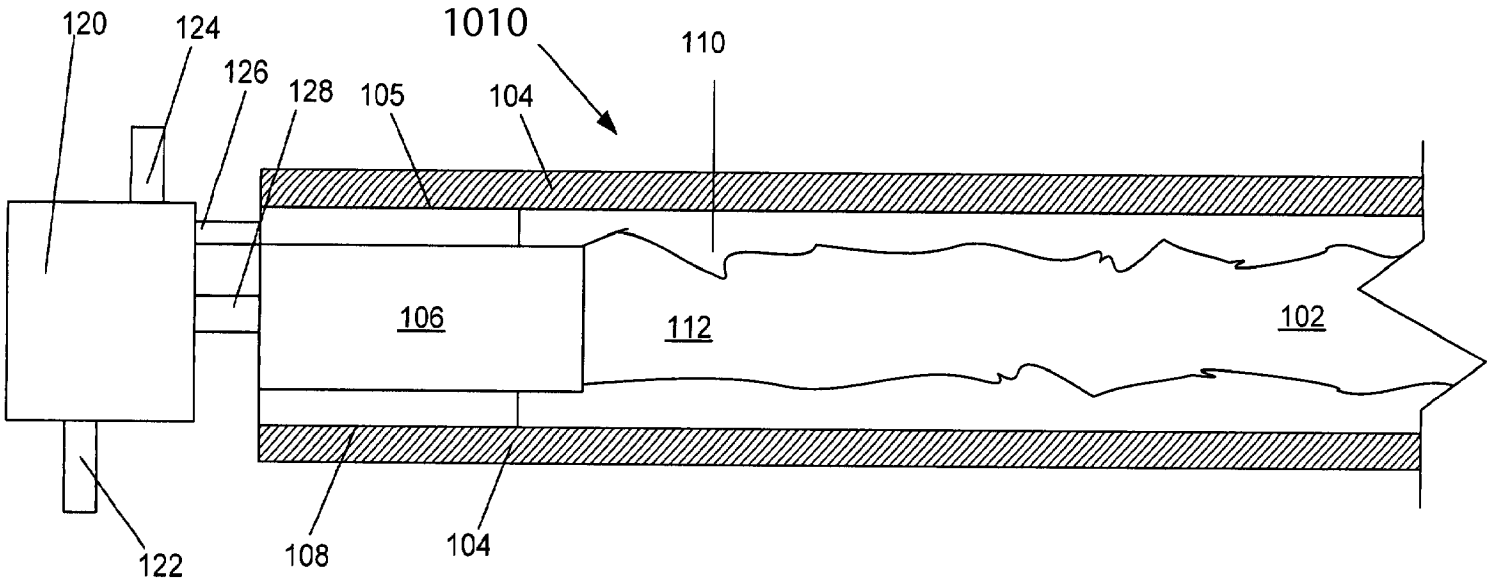
FIG. 5 is a cross-sectional view of a tubular with core flow with a nozzle and a pump.

Referring now to FIG. 5, in some embodiments of the invention, tubular 1010 is illustrated. Tubular 1010 includes tube element 104 enclosing passage 102. Nozzle 105 may be provided in passage 102, and includes large diameter nozzle portion 108 and small diameter nozzle portion 106. Small diameter nozzle portion 106 may be feeding first fluid 112 and a gas, and large diameter nozzle portion 108 may be feeding second fluid 110 around first fluid 112. This creates a core flow arrangement of first fluid 112 and the gas, surrounded by second fluid 110. Pump 120 may be provided upstream of nozzle 105 to pump first fluid 112 and the gas from inlet 124 to outlet 128 and into small diameter nozzle portion 106, and to pump second fluid 110 from inlet 122 to outlet 126 and into large diameter nozzle portion 108. In some embodiments, water may be provided from the surface, optionally with one or more chemical additives, through a conduit to inlet 122 of pump 120. In some embodiments, oil and gas from a formation may be collected in a tubular and provided to inlet 124 of pump 120.

Table 2, below, shows the bases, concentrations and temperatures, experimental setup, test duration, TAN measurements, and percent TAN upgrading with respect to the neat high acid number crude oil. As shown in Table 2, sodium hydroxide proved to be most effective at reducing the TAN compared to other bases used. Temperature was not shown to be a major factor in the conversion and thus the effects of this variable were not studied in this experiment; however, one of ordinary skill in the art will recognize that this is not intended to limit the scope of the present disclosure. The best results (almost 100% TAN reduction) were observed, as shown in Table 2, by translating the rotating wheel experiments to the large flow loop coreflow experiment with 4% NaOH in the 20% water cut with high TAN crude oil.

TABLE 2

TAN Upgrading of High Acid Number Crude Oil During Coreflow Using Different Base Materials

| Base/ Temperature | Experimental Setup | Test Duration (hr:min) | Presoak $Na_2SiO_3$ | Final TAN | % Upgrading |
|---|---|---|---|---|---|
| High acid number crude oil | | | | 10.4 (Av) | — |
| 1% NaOH, 95° F. | Tygon rotating wheel flow loop | 4:00 | No | 6.5 | 37 |
| 1% $Na_2CO_3$, 95° F. | Tygon rotating wheel flow loop | 9:00 | No | 7.7 | 25 |
| 4% NaOH, 130° F. | Glass rotating wheel flow loop | 5:00 | 15% | 1.23 | 88 |
| 10% $Na_2CO_3$, 140° F. | Glass rotating wheel flow loop | 8:00 | 15% | 2.02 | 81 |
| 2% NaOH, 130° F. | Glass rotating wheel flow loop | 3:00 | 5% | 6.5 | 42 |
| 4% $Na_2CO_3$, 140° F. | Glass rotating wheel flow loop | 24:00:00 | 5% | 4.95 | 52 |
| 10% $Na_2SiO_3$, 105° F. | Glass rotating wheel flow loop | 3:00 | 5% | 3.88 | 61 |
| 10% $(C_2H_5)_3N$, 105° F. | Glass rotating wheel flow loop | 20:00 | 5% | 6.34 | 39 |
| 4% $NaBO_2$, 105° F. | Glass rotating wheel flow loop | 2:00 | 5% | 7.16 | 40 |
| 4% NaOH | Large scale flow loop | 1:10 | 500 ppm | 0.1 | 99 |

Comments: The Presoak Na2SiO3 solution is sodium metasilicate, the % upgrading is the % reduction of the TAN from its initial value of 10.4, the glass and the tygon rotating wheel flow loop are identical wheels initially loaded with crude oil and the alkaline solution. Samples are taken at different intervals and analyzed for TAN. The large scale flow loop is a permanent flow loop located at the Flow Assurance Laboratory) at Shell's Westhollow Technology Center.

Flow loop tests were conducted to determine salt concentrations, bases and their concentrations, wetting agent and its concentration, water cut, fluid temperature, flow loop length, test duration, and core flow mixing time. The results from the flow loop tests are shown in Table 3, below. By applying different amount/type of base materials at different salinity, it may be determined which combination provides the best TAN reduction while still maintaining core flow. As shown in Table 3, tests 1-7 were conducted using sodium hydroxide as the alkaline chemical at different concentrations; tests 8-9 were conducted using 1 percent weight potassium hydroxide.

TABLE 3

Summary of flow loop testing on core flow TAN

| Test | NaCl wt % | Neutralizer wt | $Na_2SiO_3$ ppm | $H_2O$ vol % | Fluid Temp ° F. | Pipe Length ft | Test Duration min | Core Flow min |
|---|---|---|---|---|---|---|---|---|
| 1 | 3 | 4% NaOH | 250 | 18 | 97 | ~250 | 35 | — |
| 2 | 10 | 4% NaOH | 300 | 24 | 100 | ~250 | 50 | 50 |
| 3 | 10 | 4% NaOH | 300 | 25 | 105 | ~375 | 86 | 58 |
| 4 | 10 | 4% NaOH | 300 | 20.4 | 95 | ~375 | 83 | — |
| 5 | 0 | 4% NaOH | 300 | 20 | 100 | ~375 | 61 | — |
| 6 | 1 | 0.75% NaOH | 250 | 23 | 100 | ~375 | 240 | 240 |
| 7 | 0 | 0.75% NaOH | 250 | 23 | 108 | ~375 | 15 | — |
| 8 | 1 | 1% KOH | 250 | 23 | 100 | ~375 | 25 | — |
| 9 | 0 | 1% KOH | 250 | 23 | 100 | ~375 | 300 | 300 |

Comments: Certain water compositions are not conducive to core flow. Neutralizing the BS4 oil by reacting it with alkali, will create naphthenic acid salts that are strong emulsifiers and in principle will most likely destroy coreflow. However, for some conditions, coreflow survives for as long a time as the transient time of the fluid in the production fluid and subsea flowline (for subsea well case), then both the benefits of coreflow and of the reduction in the total acid number of the crude oil would have been accomplished during oil transport. Thus we have been able to reduce TAN whithout impairing the core flow regime or the subsequent oil dehydration.

As shown in Table 3, above, Test 1 never established core flow and Test 2 only established and maintained core flow for about 50 minutes. The purpose of the testing was to apply different amount/type of neutralizing base chemical at different salinity and figure out which combination can provide the best TAN reduction while still maintaining coreflow for a sufficiently long period of time equal or larger than the expected fluid transit time in a real production system. The disappearance of core flow in Test 2 may be attributed to the low pressure on water injection. Core flow was successfully established in Test 3 and lasted for about one hour before emulsification, then became unstable due to a temperature increase. Tests 4 and 5 have susceptible oil samples in the flow loop, which introduce fluctuations of the flow rates and pressures. Successful core flow was established in Test 6 and maintained for about four hours until the system was shutdown. However, during Test 6, core flow was lost then regained a few times due to possible air pockets in the flow loop. Additionally, core flow was re-established when the flow loop was restarted without any adjustment. Tests 7 and 8 were carried out for a very short time so that it was too short to get any data or samples. Test 9 presents a successful core flow phenomenon that consists of two parts: the first part is establishment of coreflow followed by shut-in while the second part of the test is system restart with re-establishment of coreflow.

Although 4% (wt) sodium hydroxide appears to be the best candidate for reducing to almost 100% of the TAN of high acid number crude oil, it could not maintain the core flow more than 1 hour as shown in tests 1-5. This is due to the formation of the emulsion in the flow loop. The naphthenic sodium salts are strong emulsifiers and they appear to destroy core flow within 30 minutes to an hour in the flow loop. However, as shown in the results above, almost 100% TAN reduction can be achieved with 4% NaOH within 15 minutes or less of core flow. In addition, the transient time of high acid number crude oil in a wellbore will be of the order of 15 minutes or less. Therefore TAN reduction with core flow for high acid number crude oil Direct Vertical Access (DVA) wells is feasible. These salts are generated by the napthenic acids reacting with the bases/alkalis Embodiments of the present disclosure may include one or more of the following advantages: a method/system that efficiently neutralizes organic acids contained in acidic heavy oils to reduce the total acid number of such oils, thus simultaneously increasing the marketability and value of the crude oil; a system that allows for reduction of penalties imposed by refiners due to the severe corrosiveness of high TAN crudes on refinery equipment; and a system that uses the wellbore or the subsea flowline as the reactor where the neutralization of the heavy oil will occur, thus minimizing the equipment needed and cost associated with the neutralization.

Illustrative Embodiments:

In one embodiment, there is disclosed a system adapted to transport two fluids, comprising a nozzle comprising a first nozzle portion comprising the first fluid; and a second nozzle portion comprising the second fluid, wherein the second nozzle portion has a larger diameter than and is about the first nozzle portion; and a tubular fluidly connected to and downstream of the nozzle, the tubular comprising the first fluid in a core, and the second fluid about the core; the first fluid comprising a crude oil having a total acid number greater than 1, and the second fluid comprising a basic solution having a pH greater than 8. In some embodiments, the first fluid comprises a higher viscosity than the second fluid. In some embodiments, the system also includes a pump upstream of the nozzle, wherein the pump has a first outlet to the large diameter nozzle portion and a second outlet to the small diameter nozzle portion. In some embodiments, the system also includes a pump downstream of the nozzle, wherein the pump is adapted to receive a core flow from the nozzle into a pump inlet. In some embodiments, the first fluid comprises a viscosity from 30 to 2,000,000, for example from 100 to 100,000, or from 300 to 10,000 centipoise, at the temperature and pressure the first fluid flows out of the nozzle. In some embodiments, the second fluid comprises a viscosity from 0.001 to 50, for example from 0.01 to 10, or from 0.1 to 5 centipoise, at the temperature and pressure the second fluid flows out of the nozzle. In some embodiments, the second fluid comprises an aqueous sodium hydroxide solution. In some embodiments, the second fluid comprises from 5% to 40% by volume, and the first fluid comprises from 60% to 95% by volume of the total volume of the second fluid and the first fluid as the second fluid and the first fluid leave the nozzle. In some embodiments, the second fluid comprises a basic solution having a pH greater than 10. In some embodiments, the second fluid comprises a basic solution having a pH greater than 12. In some embodiments, the first fluid comprises a crude oil having a total acid number greater than 5, for example greater than 7 or 9. In one embodiment, there is disclosed a method for transporting a first fluid, a second fluid, and a gas, comprising injecting the first fluid through a first nozzle portion into a core portion of a tubular; injecting the second fluid through a second nozzle portion into the tubular, the second fluid injected about the core portion of the first fluid and the gas; wherein the first fluid comprises a hydrocarbon liquid having a total acid number greater than 2, and wherein the second fluid is a basic solution having a pH greater than 9.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for transporting a first fluid and a second fluid, comprising: injecting the first fluid through a first nozzle portion into a core portion of a tubular, wherein the first fluid comprises a crude oil having a total acid number greater than 1 and injecting the second fluid through a second nozzle portion into the tubular, wherein the second nozzle portion has a larger diameter than the first nozzle portion and is about the first nozzle portion and wherein the second fluid comprises a basic solution having a pH greater than 8.

2. The method of claim 1, wherein the first fluid comprises a higher viscosity than the second fluid.

3. The method of claim 1, wherein the first fluid has a viscosity from 30 to 2,000,000 at the temperature and pressure the first fluid is injected through the first nozzle portion.

4. The method of claim 1, wherein the second fluid has a viscosity from 0.001 to 50 at the temperature and pressure the second fluid is injected through the second nozzle portion.

5. The method of claim 1, wherein the second fluid comprises an aqueous sodium hydroxide solution.

6. The method of claim 1, wherein the second fluid comprises a basic solution having a pH greater than 10.

7. The method of claim 1, wherein the second fluid comprises a basic solution having a pH greater than 12.

8. The method of claim 1, wherein the first fluid comprises a crude oil having a total acid number greater than 5.

9. A method for transporting a first fluid, a second fluid, and a gas, comprising:

injecting the first fluid through a first nozzle portion into a core portion of a tubular, wherein the first fluid comprises a hydrocarbon liquid having a total acid number greater than 2 and injecting the second fluid through a second nozzle portion into the tubular, wherein the second fluid is a basic solution having a pH greater than 9 and is injected about the core portion of the first fluid and the gas.

* * * * *